US010000317B2

(12) United States Patent
Van Oosten

(10) Patent No.: US 10,000,317 B2
(45) Date of Patent: Jun. 19, 2018

(54) PAIL, CLOSING RING, AND METHOD FOR ASSEMBLING A PAIL

(71) Applicant: Ardagh MP Group Netherlands B.V., Deventer (NL)

(72) Inventor: Andries Van Oosten, Deventer (NL)

(73) Assignee: Ardagh MP Group Netherlands B.V., Deventer (NL)

( * ) Notice: Subject to any disclaimer, the term of this patent is extended or adjusted under 35 U.S.C. 154(b) by 0 days. days.

(21) Appl. No.: 15/103,455

(22) PCT Filed: Dec. 11, 2014

(86) PCT No.: PCT/EP2014/077381

§ 371 (c)(1),
(2) Date: Jun. 10, 2016

(87) PCT Pub. No.: WO2015/086747

PCT Pub. Date: Jun. 18, 2015

(65) Prior Publication Data

US 2016/0311584 A1 Oct. 27, 2016

(30) Foreign Application Priority Data

Dec. 11, 2013 (EP) ..... 13196733

(51) Int. Cl.

| | |
|---|---|
| ***B65D 45/34*** | (2006.01) |
| ***B65D 43/02*** | (2006.01) |
| ***B65D 1/12*** | (2006.01) |

(52) U.S. Cl.

CPC ..... *B65D 45/345* (2013.01); *B65D 1/12* (2013.01); *B65D 43/022* (2013.01);
(Continued)

(58) Field of Classification Search

CPC ..... B65D 45/345; B65D 2543/00092; B65D 2543/00537; B65D 11/06; Y10T 292/216; Y10T 292/212

(Continued)

(56) References Cited

U.S. PATENT DOCUMENTS 2,453,492 A * 11/1948 Carter ..... B65D 45/345 24/270
4,413,850 A * 11/1983 Siblik ..... B65D 45/345 292/256.69

(Continued)

FOREIGN PATENT DOCUMENTS

| | | |
|---|---|---|
| DE | 955 646 | 1/1957 |
| DE | 33 45 509 | 5/1985 |
| EP | 0 563 567 | 10/1993 |

OTHER PUBLICATIONS

International Search Report, PCT/EP2014/077381, dated Mar. 17, 2015.

(Continued)

*Primary Examiner* — Shawn M Braden
(74) *Attorney, Agent, or Firm* — Cook Alex Ltd.

(57) ABSTRACT

The present invention relates to a pail body having a pail end defining a pail opening, a lid closing the pail opening, and a clamping ring clamping the lid onto the pail end, wherein the clamping ring comprises a lever connected to the ends of a split clamping ring, which lever in a closed position clamps the split clamping ring onto the pail end, and in an open position widens the ring, and spring means connecting the lever to at least one of the ring ends, to the clamping ring, and a method for applying the clamping ring to a pail body.

20 Claims, 6 Drawing Sheets

(52) U.S. Cl.
CPC ..... *B65D 2543/0024* (2013.01); *B65D 2543/00092* (2013.01); *B65D 2543/00277* (2013.01); *B65D 2543/00509* (2013.01); *B65D 2543/00537* (2013.01); *B65D 2543/00546* (2013.01); *B65D 2543/00555* (2013.01); *B65D 2543/00638* (2013.01); *B65D 2543/00685* (2013.01); *B65D 2543/00731* (2013.01); *B65D 2543/00796* (2013.01); *B65D 2543/00972* (2013.01)

(58) Field of Classification Search
USPC ..... 220/321
See application file for complete search history.

(56) References Cited

U.S. PATENT DOCUMENTS 5,295,604 A * 3/1994 Van Ryswyk ..... B65D 45/345 220/321
7,497,489 B2 * 3/2009 Baughman ..... B65D 45/345 292/256.65
7,802,827 B2 * 9/2010 Easterday ..... B65D 45/345 220/321
8,480,134 B2 * 7/2013 Crompton ..... F16L 37/0915 285/315
8,985,647 B2 * 3/2015 Kuzelka ..... B65D 45/345 292/256.65
2012/0267373 A1 10/2012 Starr et al.

OTHER PUBLICATIONS

Notification of International Search Report and the Written Opinion of the International Searching Authority, PCT/EP2014/077381, dated Mar. 17, 2015.

* cited by examiner

PAIL, CLOSING RING, AND METHOD FOR ASSEMBLING A PAIL

FIELD OF THE DISCLOSURE

The present invention relates to a pail, to a closing ring for a pail, and to a method for assembling a pail with a lid and the closing ring.

BACKGROUND OF THE DISCLOSURE

Pails, for instance pails for paint, ink and other past like materials, are generally filled in pails which are closed with a lid. The lid is secured on the pail using a clamping ring.

The pail is generally provided with a lid comprising over its circumference lugs. The lid is pushed on the pail and thereafter, the lugs are bended inwardly and beyond and beneath an edge of the pail body. Accordingly, the pail is reliably secured onto the pail in effectively a single push on procedure. However, for removing the lid from the pail extensive handling is required, because all lugs have to be bended backwardly in order to detach all lugs. When closing the pail the lugs have to be bend inwardly. This well known pail provides for a relatively simple push on procedure for mounting and securing the lid on the pail body. The use by the user is far from ideal.

An alternative is represented by a pail comprising a clamping ring which clamps the lid on the free end of the pail body and grips or snaps behind a circumferential ridge in the pail body. The clamping ring is provided with a lever closure. The lever closure comprises a lever, which in the closed position imparts to the split clamping ring its minimal diameter, and in the open position, widens the clamping split ring to a larger diameter. In the larger diameter the ring may be applied onto the lid and secures the lid onto the pail by just transferring the lever from the open position to the closed position. The use of a clamping ring provides optimal handling for the user because opening and closing the pail requires a simple handling with the lever. But for the customer filling and closing pails at high rates such clamping ring closure in not suitable as it does not allow the mounting and securing the lid onto the pail body with the generally used pushed on procedure.

Still for any lid closure of the pail it is required that the pail complies with the safety required for such pails. The pail has to pass a drop test, such as for a pail of 20 liters a drop test from a height of 1.80 m onto a metal surface when dropped in a slanted position. For other pails similar stringent drop tests apply. Other tests are the hydraulic pressure test of 1.0 bar, and the air tightness test of 0.2 bar, and that stacking test.

Finally, the closure for a pail lid should also allow for tight packing and storing of the filled and closed pails, such that large numbers of pails can be stored in stacked layers on standard pallets, such as euro pallets. Similar requirements apply for pails to be filled, and for the lids to be used.

SUMMARY OF THE DISCLOSURE

The present invention has for its object to provide a pail onto which a lid may be reliably mounted and secured, although in this procedure the application of the lid is carried out by only a push on step, with additional handlings or procedures such as the opening and closing of a lever, and/or bending lid lugs. In addition, the handling, opening and closing of such pail should be consumer friendly and preferably does not require the use of any opening or closing tools. Storage in stacked layers in high densities of the empty and filled pails, and lids should be possible using standard storage and transportation and handling means.

These objects according to the invention are met by providing a pail comprising a pail body having a pail end defining a pail opening, a lid closing the pail opening, and a clamping ring clamping the lid onto the pail end, wherein the clamping ring comprises a lever connected to the ends of a split clamping ring, which lever in a closed position clamps the split clamping ring onto the pail end, and in an open position widens the ring, and spring means connecting the lever to at least one of the ring ends.

The invention is based on the insight that the use a lever for clamping the clamping ring onto a pail is a very consumer friendly type of closure, easily to open and close and not requiring tools for opening or closing. Still, the push on traditional and widely used procedure applying the lid and the clamping ring onto the pail can be carried out without any further handling steps, such as temporarily bringing the lever in an open position for widening the clamping split ring, and after application closing the lever to the closed position can also be avoided. Thereto, the connection between the lever and at least one ring end is accomplished via spring means. The spring means generally maintain the split clamping ring in its smallest diameter by applying a sufficient circumferential or hoop spring force. When during the push on mounting of the lid with this closing ring according to the invention the ring is urged against the spring load to temporarily widening the clamping split ring, without changing the position of the lever, such that at a minimal larger diameter the ring can pass over the pail end. Thereafter, the spring urges the ends of the clamping split ring towards each other and reduces the diameter to its smallest diameter. The spring load is selected such, that such temporary widening of the clamping split ring is possible, but when clamped onto the pail the spring force is sufficient for allowing sufficient clamping. The pail should be product (such as paint or ink), water and air tight during handling, transport and ordinary use. When the pail with closure requires UN-approval, this would mean for instance, that the pail provided with the lid and the clamping ring will pass a drop test. For pails of 20 liter, the drop test is carried out with filled pails dropped from a height of about 1.80 m.

Evidently, the pail may be opened by the consumer by a relatively simple opening procedure which is bringing the lever from its closest position into its open position, wherein the split clamping ring widens and attains its larger diameter. The closing of the split clamping ring goes against the spring load, but the momentum generated by the lever is sufficient for manually overcoming the spring load force during the closing procedure. The opening of the split clamping ring does not substantially go against the spring load.

Thus, the desired push on closing the pail with the lid in a reliable manner by the customer, and the easy opening by the user are combined in an inventive manner.

According to a preferred embodiment, the lever comprises a lever end connected by hinge means to a first ring end, a connector connected by hinge means to a middle lever part, and by hinge means to a second ring end, and wherein the spring means connect the lever end and/or the connector to the respective ring end. In this embodiment, the hinge means and also the spring means are acting on the connection of the connector to the middle lever part. This provides a reliable connection which may be even shielded from the surroundings using a construction wall.

In an alternative embodiment, the lever comprises a lever end connected by hinge means to a first ring end and a connector connected by hinge means to a middle lever part and by hinge means to a second ring end, and wherein the spring means connect the lever end and/or the connector to the respective ring end. In this embodiment, the spring means act on the connection of the lever end and/or the connector to its respective ring end.

For an optimal guidance of the widening of the lever connection during the push on of the lid with the split clamping ring onto the pail, it is preferred that the connector comprises connector strips extending laterally along the lever in the closed position, and the hinge means are slideably mounted in the connector strips provided with guiding means such as a guiding slot. Accordingly, the sliding of the respective parts of the lever closure is optimally guided.

If according to the other embodiment, the spring means are connected to the lever ends and/or the connector to the respective ring end, than the hinge means are slideably connected to the ring strips provided with guiding means, such as guiding slots. In the same manner, the sliding of the connector or the lever end is optimally secured.

It is most preferred, when the hinge means connecting the connector to the middle lever part are slideably mounted in the connector strips provided with guiding means such as guiding slots. In this manner, the spring loaded lever connection is reliable, simply shielded from the outside, and having an arc length which is minimal. The latter is beneficial for the ultimate stacking of the filled and closed pails onto a pellet, such as an euro pallet.

Within the concept of the invention any type of spring means may be used. For instance, may be used for compressions spring means in which the spring load is generated by compressing the spring means. In the alternative, pull spring means may be used for which the spring load is generated by pulling the spring means. A preferred form of spring means are zig-zag spring means which are providing optimal spring force although the zig-zag spring means are compact and do not require much spring length.

For an optimal mounting of the lid with the clamping ring onto the pail end, it is preferred that the pail end comprises an outwardly extending guiding surface for the clamping ring. In an alternative manner, the clamping ring comprises a ring edge having a guiding surface for cooperation with the pail end. Preferably, the pail is provided with a guiding surface, and clamping ring provided with another guiding surface which are cooperating when the split clamping ring is pushed onto the pail end.

For an optimal mounting of the clamping ring onto the pail end, it is preferred that the ring edge comprises an inwardly extending projection which snaps behind the pail end.

For providing an optimal storage at a minimum occupied surface, it is preferred that the pail end is located in a necked pail body section, and the clamping ring and the lever reside within the outer contour of the pail.

The pail may have dimensions, such that 22 pails may be mounted on a euro pallet (800×1200 mm), because for instance the arc length of the lever spring closure is sufficiently small such that the lever may be accommodated in the interstitial space between three mutually connecting pails.

Another aspect of the invention relates to a lever connected to the ends of a split clamping ring which lever in a closed position clamps the ring onto a pail end, and in an open position opens the clamping ring, and spring means connected the lever at least one ring end.

Another aspect of the invention relates to the step of pushing the clamping ring over the lid onto the pail in a clamping arrangement, wherein the split ring against spring load temporarily widens when the pail end passes through the ring. For an optimal closing of such a pail according to the invention, it is advisable for the customer to be provided with a lid already provided with the clamping ring, such that this combination of lid and clamping ring can be pushed on in one operation onto the pail.

Preferably, the pail has a pail end comprising an outwardly extending guiding surface and/or the clamping ring comprises a ring edge having a guiding surface, and during the pushing step the guiding surface or guiding surfaces guide the pushing of the clamping ring over the lid, and temporarily widening of the clamping ring.

BRIEF INTRODUCTION OF THE FIGURES

Mentioned and other characteristic features of the pail, the closing ring and a method according to the invention will be further discussed and will become apparent by reference to several embodiments, which are presented for explanatory purposes but not intended to limit the invention to any extent. Thereto reference is made to the drawings, wherein FIGS. 1-3 show in perspective views the formation of a set comprising a lid and clamping ring, followed by the push on mounting of this set on a pail;

Figure 4A:
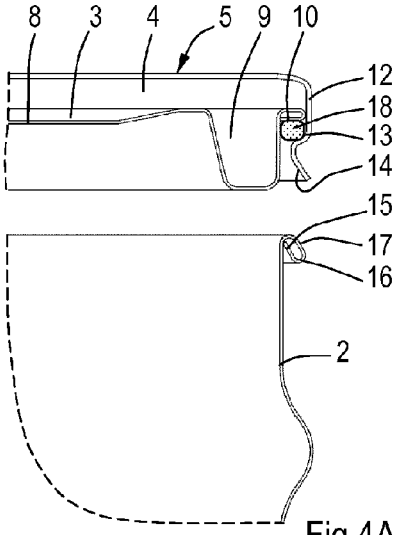
FIGS. 4A-4F show steps of a method according to the invention.
Figure 4B:
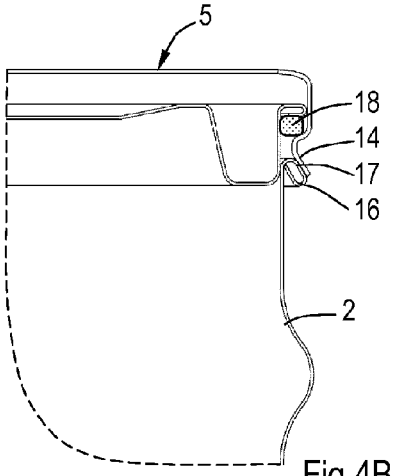
Figure 4C:
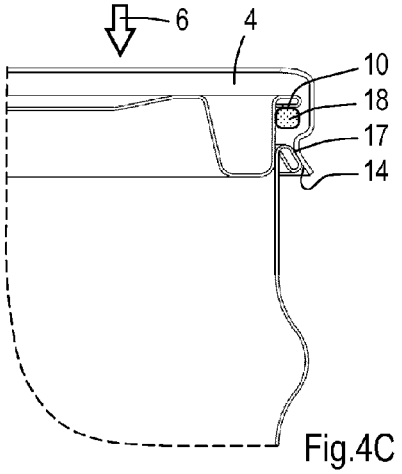
Figure 4D:
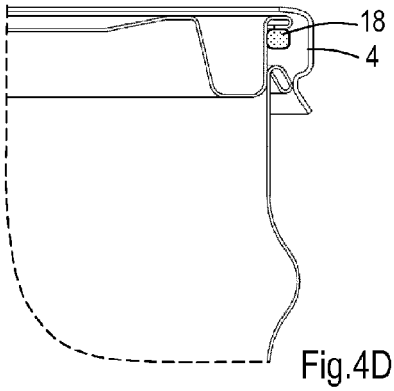
Figure 4E:
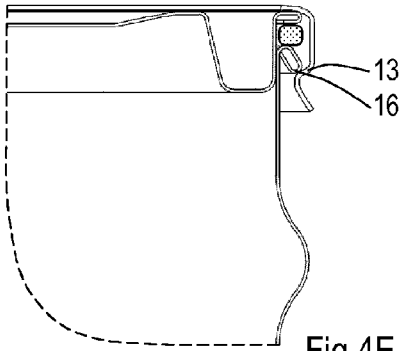
Figure 4F:
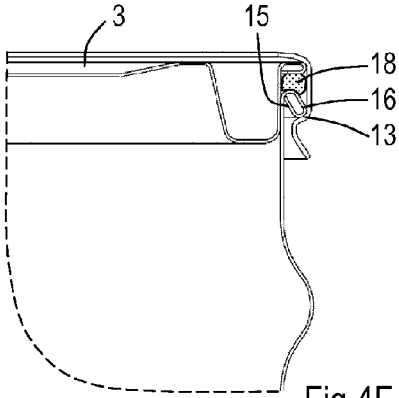
Figure 9:
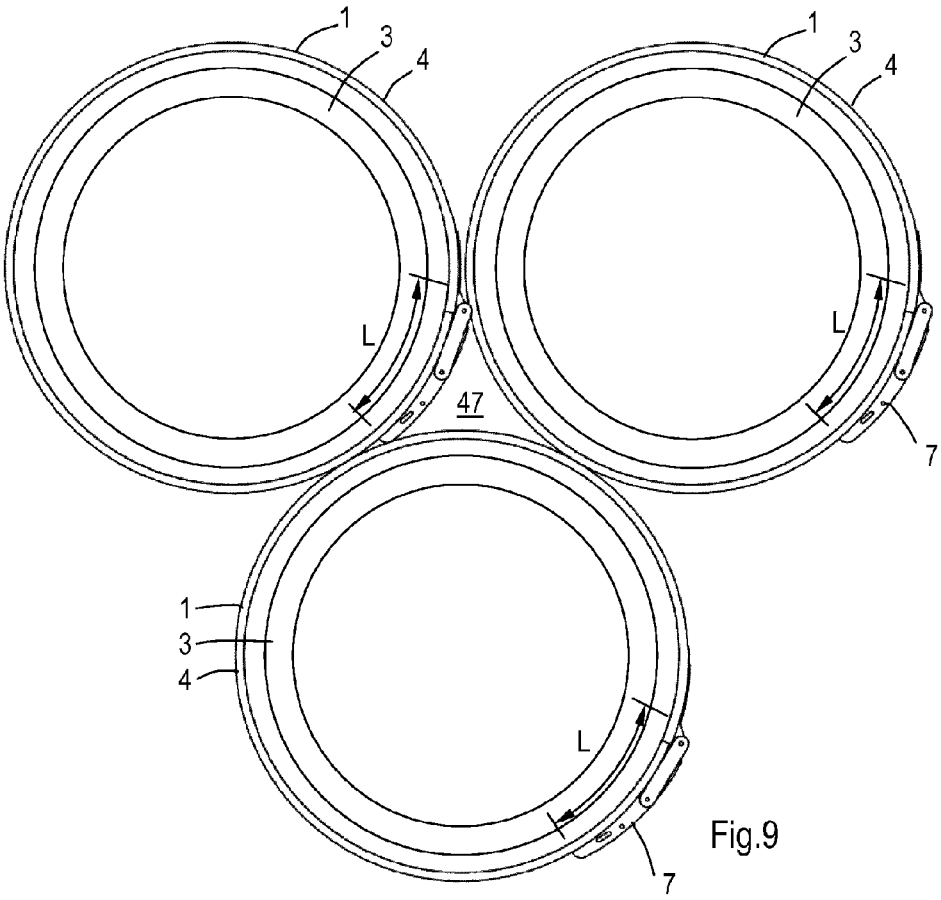
Figure 10:
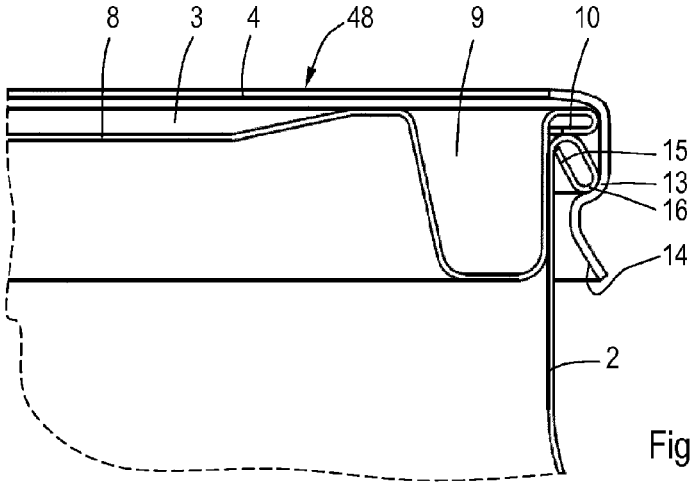

FIG. 9 in top view the optimal storage of pails provided with the lid and clamping ring according to the invention; and FIG. 10 in cross section an alternative of the pail of the invention as shown in FIG. 4F.

ILLUSTRATED DISCUSSION OF THE DETAILED EMBODIMENTS

Figure 1:
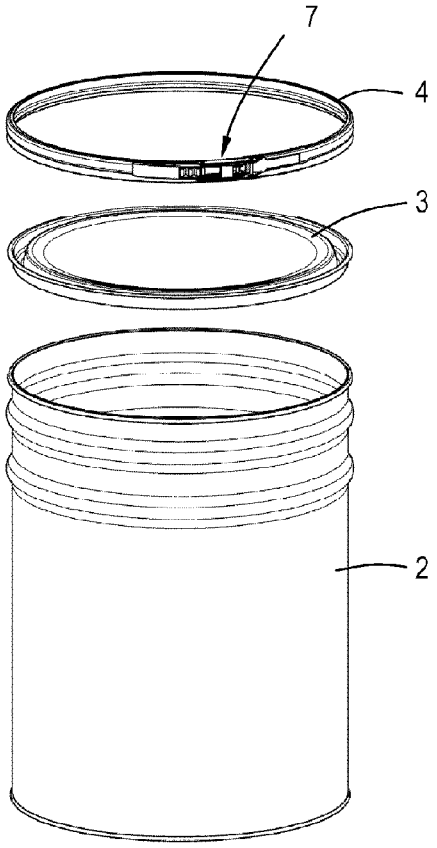
Figure 2:
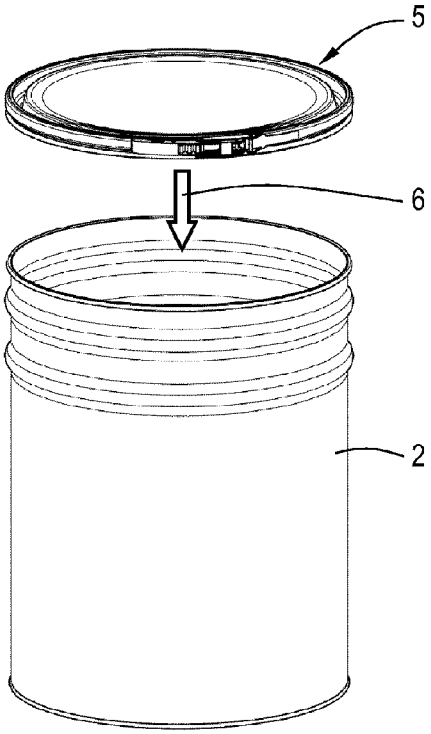
Figure 3:
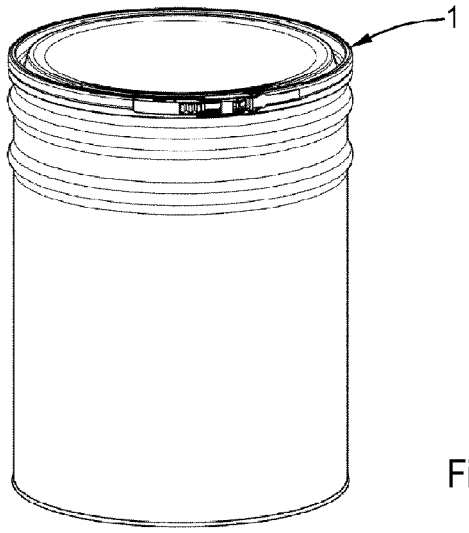

FIGS. 1-3 show a pail 1 according to the invention, and the mounting on the pail body 2 of a lid 3 with a clamping ring 4. As shown, the clamping ring 4 is first mounted onto the lid 3, and this set 5 is pushed on the pail body 2 according to the arrow 6. The push on mounting of the set 5, in particular the clamping ring 4 onto the pail body is accomplished by temporarily widening the lever closure 7 for the split clamping ring 4.

FIGS. 4A-4F show the push on method according to the invention. The set 5 comprises the lid 3 and the clamping ring 4. The lid 3 comprises a central panel 8 surrounded by a counter sink 9 and ending in a curled lid edge 10. The clamping ring 4 comprises a downwardly directed skirt 12 provided with an inwardly directed projection 13 and ending in an outwardly extending guiding surface 14. The diameter of the projection 13 is such that the lid edge 10 is resting on the projection 13 but may move still along the skirt 12. In this respect it is noted, that the projection 13 may be a circumferential projection, or may comprise projection parts which are circumferentially spaced.

The pail body 2 comprises a pail end 15 provided with an outward curl having an elongated form and provided with a guiding surface 17.

When the set 5 is mounted onto the pail body 2 the set 5 rests with the guiding surface 14 onto the guiding surface 17 of the curl 16. Pressing the push on force according to arrow 6, results in a sliding of the guiding surface 14 over the guiding surface 17 whereby the distance between the clamping ring 4 and the lid edge 5 decreases, see FIG. 4C. The ultimate position, in which the clamping ring 4 has its largest diameter by widening the clamping ring 4, is shown in FIG. 4D. Subsequently, the projection 13 snaps under the spring load of the spring means 34, behind the curl 16 (see FIG. 4E), and the ultimate closed position is shown in FIG. 4F, in which the curl 16 is in intimate contact with the projection 13 forming a reliable snap connection. In this situation there is a close contact in between the lid 3 and the pail end 15 because of the inter position of a compound 18.

Figure 5A:
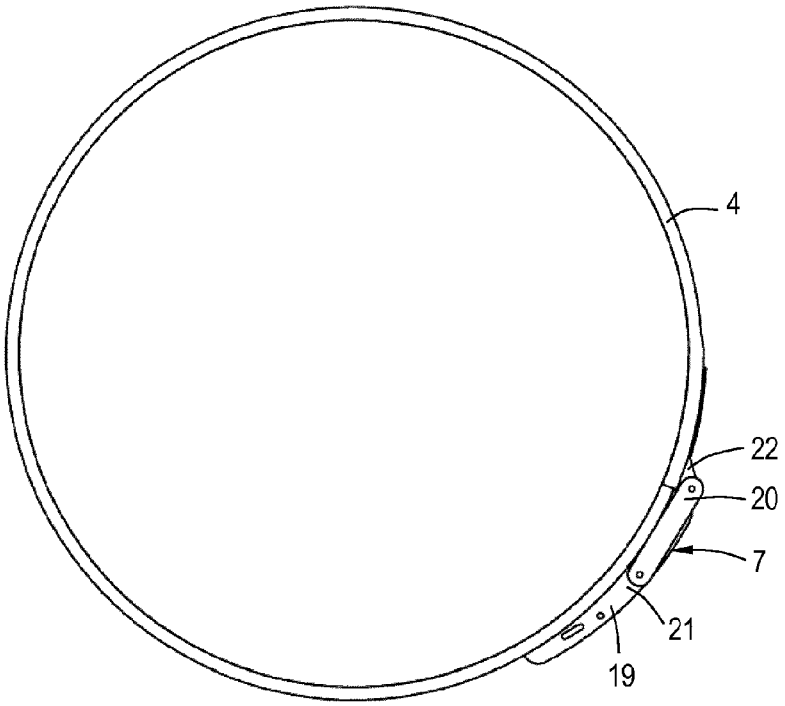
FIGS. 5A and 5B show in top view and perspective view the clamping ring according to the invention.
Figure 5B:
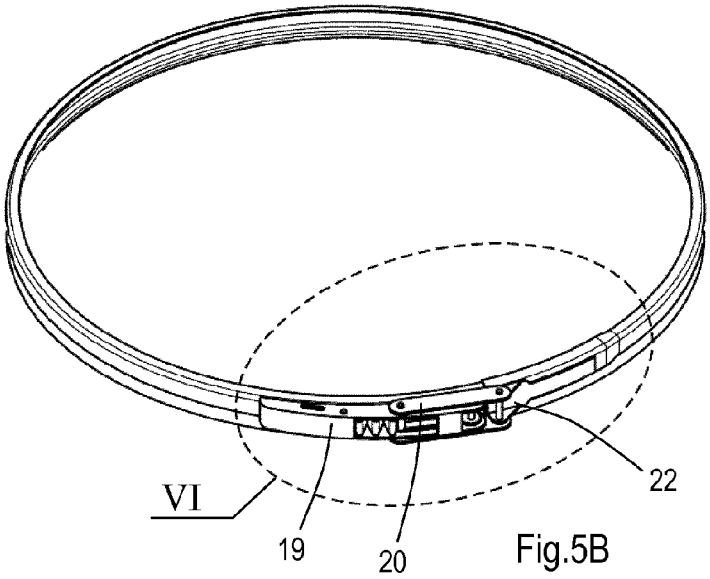

FIGS. 5A and 5B show in more detail the clamping ring 4 provided with the lever closure 7. The lever closure 7 comprises a lever 19 comprising a connector 20 connected to a middle lever part 21 and to an end 22 of the clamping ring 4.

FIGS. 6A-6D show the construction and function of a first embodiment of the lever closure 7 according to the invention.

Figure 6A:
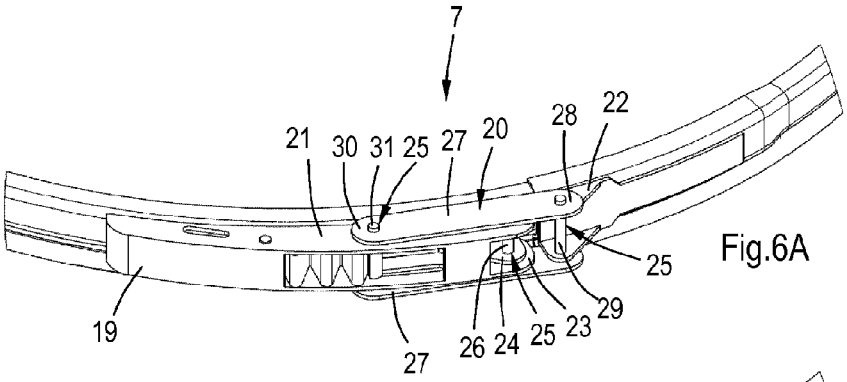
FIGS. 6A-6D show more in detail the closed and opening procedure for the split clamping ring according to the invention.

FIG. 6A shows the lever closure 7 according to the invention. The lever 19 is connected with its lever end 23 to a ring end 24. The connection is via hinge means 25 comprising a hinge pin 26.

The connector 20 comprises two connector strips 27 extending along the lever 19. The connector is connected at the connector end 28 to the ring end 22 via hinge means 25 comprising a hinge pin 29. The other connector end 30 is connected to the middle lever part 21 via hinge means 25 comprising a hinge pin 31. As shown more clearly in FIG. 6B, the hinge pin 31 connected to the connector strips 27 is guided in a slot 32 formed in the lever front part 33. Spring means 34 in the form of a zig-zag spring 35 is connected with the hinge pin 31 and at the other end with a pin 36 connected to the lever 19.

Figure 6B:
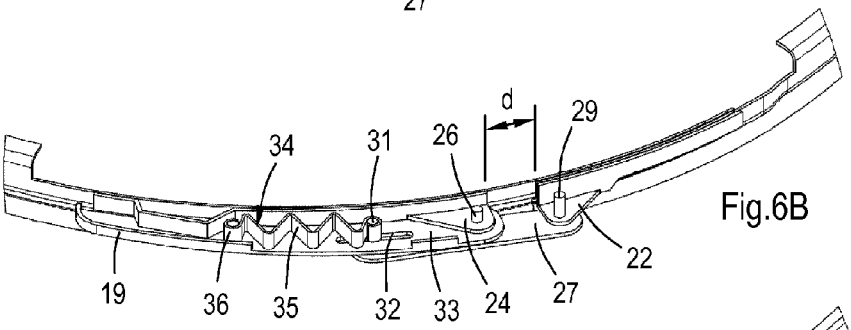
Figure 6C:
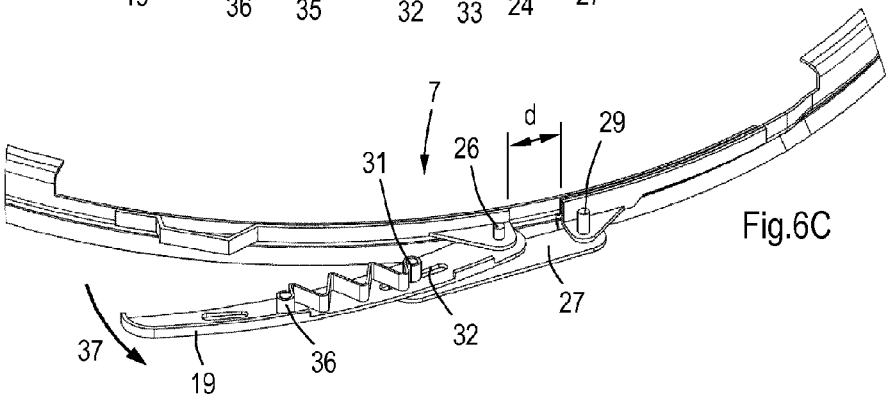

FIG. 6C shows that when the lever closure 7 is opened, by turning the lever 19 in the direction of the arrow 37 that the pin 31 slides in the slot 32.

Figure 6D:
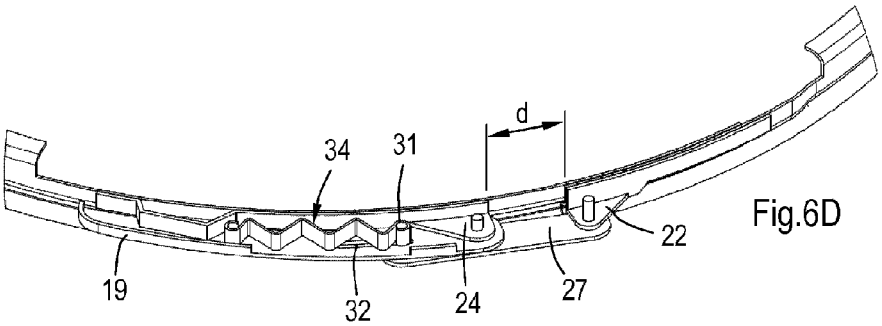

FIG. 6D shows that when a hoop force is exerted on the clamping ring 4 urging the clamping ring to increase its diameter, that the distance d between the ring end 22 and 24 increases, because the connector strips 27 with the pin 31 slides through the slot 32 against the spring force of the spring means 34. When the hoop force is reduced, the spring means 34 urge the connector to its position as shown in FIG. 6B whereby the distance d between the ring ends 22 and 24 is reduced to its original distance. It is appreciated, that this temporary widening is accomplished while the lever 19 is in the closed position as shown in FIG. 6A and there is no need for bringing the lever 19 in an opened position as shown in FIG. 6C.

Figure 7A:
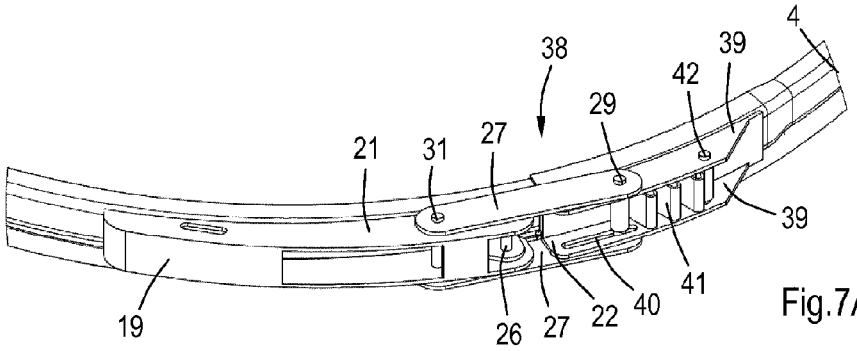
FIGS. 7A and 7B show in perspective view an alternative clamping ring according to the invention.
Figure 7B:
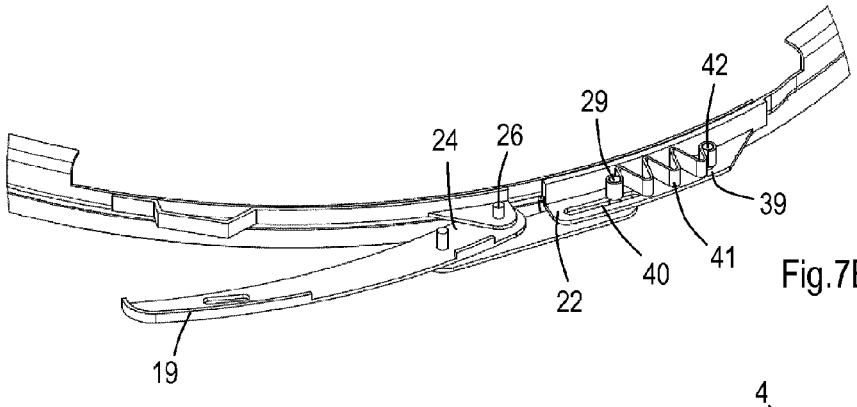

FIGS. 7A and 7B show an alternative lever closure 38 according to the invention. In this case, the hinge pin 31 is stationary and connects in stationary manner the connector strips 27 with the middle lever part 21. In this case, the ring end 22 is provided with strips 39 provided with a slot 40 in which the hinge pin 29 slides and is connected with spring means 41 to a pin 42 connected to the strips 39. In the same manner as discussed in relation to the lever closure 7, when urging a circumferential hoop force on the clamping ring 4, will result in a sliding of the pin 29 in the slot 40, towards left end of the slot 40 thereby widening the clamping ring 4 and the distance between the ring ends 22 and 24. Release of the hoop force, will result in a movement of the pin 29 in the slot 40 towards under the spring force 41 whereby the clamping ring is reduced in diameter and the ring ends 22 and 24 approach one another.

Figure 8A:
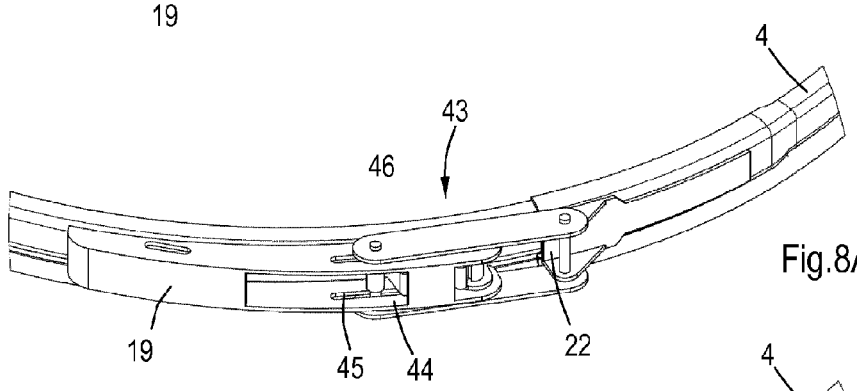
FIGS. 8A and 8B show in another perspective view another split clamping ring according to the invention.
Figure 8B:
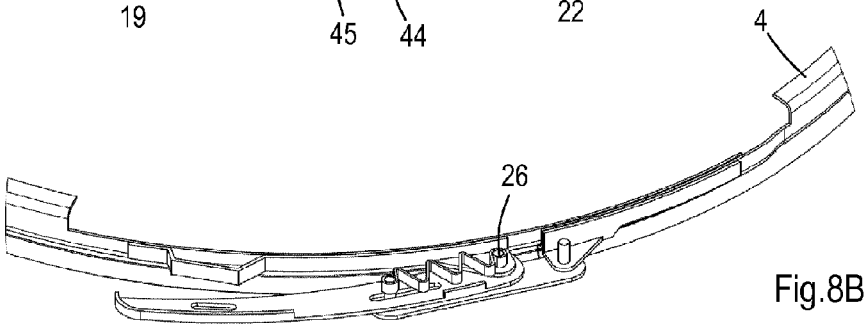

FIGS. 8A and 8B shows a further alternative of a lever closure 43 according to the invention. In this case, the ring end 24 via spring means 34 connected to the pin 36 which is slidable in a slot 45 under the spring force of spring means 34. Accordingly, in the same manner as described in relation to the lever closures 7 and 38, upon generating a hoop force, the pin 26 will slide in the slot 45 against the spring force of spring means 34 whereby the clamping ring widens and increases in diameter. Release of the hoop force will result in a sliding of the pin 36 in the slot 45 such that the ring ends 22 and 24 will approach one another and the clamping ring will obtain its original form.

Although not described in detail as an embodiment of the invention it is evident that in an alternative embodiment of the invention the clamping ring comprises a lever connected to the ends of a split clamping ring which lever in a closed position clamps the ring onto a pail end, and in an open position opens the clamping ring, and spring means connected the lever at least one ring end.

Moreover, the hinge means may be slideably connected in the middle lever part or in the connecting strips.

It is noted that these lever closures 7, 38 and 43 according to the invention are dimensioned such, that they will provide a sufficient clamping force for clamping the lid 3 on the pail body 2. Such that the pails filled to its volume will be product (such as paint and ink), water and air tight during normal handling, transport and use. When complying with the UN-approval, the pails filled to its volume will pass the drop test, such as a drop test for 20 liter pails for a drop test height of 1.80 m.

Still, when applying a push on force, when the clamping ring contacts and presses on the pail end, a sufficient hoop force is generated for temporarily widening the clamping ring 4, whereby the clamping ring may pass over and snaps beyond the pail end. Such push over force is adjusted to the clamping force of the closure and of the spring force of the spring means. The clamping force is for instance determined by the distance between the on the one hand the pins 29 and 31 of the lever in comparison to the distance between the pins 31 and 26 of the lever. This determines the clamping force of the lever 19, in particular when in its closed position the lever takes an over centered position in view of the pin 26 and the pins 29 and 31.

The pails are generally made of metal, such as steel, plated steel and the like, and have diameters up to for instance 286 mm, and having a wall thickness of the pail body of about up to 0.35 mm.

Although not discussed in detail, the lever closures according to the invention may still be provided with temper proof means which would make noticeable an undesired opening of the lever 19. On the other hand, the levers may be provided with arresting means, such that an undesired opening of the lever is avoided.

FIG. 9 shows pails 1 according to the invention of which the lid 3 is clamped on the pail body using a clamping ring 4 provided with a lever closure 7 according to the invention. The lever closure 7 has an arc length L which is of such length, that the lever closure may be confined in the interstitial space 47 between the pails 1. Such pails having a content of about 20 liter and an outer top diameter of 296 mm, such that 22 of such pails may be stacked on a euro pellet.

In this respect it is noted, that the outer dimension of the clamping ring 4 is such that it remain within the confinement of the pail body. Thereto, it is preferably and even desirable that the pail end with the lid end clamping ring is present in and on a necked portion of the pail body.

Finally, FIG. 10 shows the pail 48 which is similar to the pail shown in FIG. 4F, but a sufficiently tight closure between pail end 15 and the lid 3 is obtained without the use of a compound 18.

The invention claimed is:

1. Pail, comprising a pail body having a pail end defining a pail opening, a lid closing the pail opening, and a clamping ring clamping the lid onto the pail end, a split clamping ring having ends, wherein the clamping ring comprises a lever connected to the ends of the split clamping ring, which lever in a closed position clamps the split clamping ring onto the pail end and in an open position widens the split clamping ring, further comprising spring means having a spring load connecting the lever to at least one of the ends of the split clamping ring, and the pail end comprises an outwardly extending guiding surface for cooperation with the clamping ring, the spring means providing push-on operation whereby the split ring widens temporarily against the spring load to its open position when the pail end is passing though the split clamping ring and closes in response to the spring load to its closed position when the pail end has passed through the split clamping ring.

2. Pail, according to claim 1, wherein the lever comprises a lever end connected by hinge means to a first ring end, and a connector connected by hinge means to a middle lever part, and by hinge means to a second ring end, and the spring means connect the connector to the middle lever part.

3. Pail, according to claim 1, wherein the lever comprises a lever end connected by hinge means to a first ring end and a connector connected by hinge means to a middle lever part and by hinge means to a second ring end, and the spring means connects the lever end and/or the connector to the respective ring end.

4. Pail, according to claim 3, wherein the connector comprises connector strips extending laterally along the lever in the closed position, and the hinge means are slideably mounted in the connector strips.

5. Pail, according to claim 4, wherein the connector strips extend along one of the ends of the split clamping ring, and the hinge means is slideably connected to the connector strips.

6. Pail, according to claim 5, wherein the hinge means connects the connector to a middle lever part, the hinge means being slideably mounted in the middle lever part.

7. Pail, according to claim 1, wherein the spring means comprises a compression spring and/or a pull spring.

8. Pail, comprising a pail body having a pail end defining a pail opening, a lid closing the pail opening, and a clamping ring clamping the lid onto the pail end, a split clamping ring having ends, wherein the clamping ring comprises a lever connected to the ends of the split clamping ring, which lever in a closed position clamps the split clamping ring onto the pail end and in an open position widens the split clamping ring, further comprising spring means having a spring load connecting the lever to at least one of the ends of the split clamping ring, wherein the clamping ring comprises a ring edge having a guiding surface for cooperation with the pail end, the spring means providing a push-on operation whereby the split ring widens temporarily against the spring load to its open position when the pail end is passing though the split clamping ring and closes in response to the spring load to its closed position when the paid end has passed through the split clamping ring.

9. Pail, according to claim 8, wherein the ring edge comprises an inwardly extending projection which snaps behind the pail end.

10. Pail, according to claim 1, wherein the pail end is located in a necked pail body section, the pail has an outer contour, and the clamping ring and the lever reside within the outer contour of the pail.

11. Pail, according to claim 1, having dimensions such that 22 pails can be mounted on a euro pellet.

12. Clamping ring for a pail, comprising a split clamping ring having ends, a lever connected to the ends of the split clamping ring, which lever in a closed position clamps the ring onto a pail end, and in an open position opens the clamping ring, and spring means having a spring load connected to the lever and at least one of the ends of the split clamping ring, and the clamping ring further comprises a ring edge having a guiding surface for cooperation with the pail end, the spring means providing push-on operation to the clamping ring whereby the split clamping ring widens temporarily against a spring load biasing of the clamping ring and closes in response to the spring load when the pail end has passed through the split clamping ring.

13. Method for assembling a set comprising a pail lid and a clamping ring according to claim 12 onto a pail, comprising pushing the clamping ring over the lid onto the pail in a clamping arrangement, wherein the clamping ring, against spring load biasing of the spring means, temporarily widens when the pail end passes through the ring, further comprising mounting the clamping ring onto the lid, and pushing the ring mounted on the lid onto the pail.

14. Method as claimed in claim 13, wherein the pail has a pail end comprising an outwardly extending guiding surface and/or the clamping ring comprises a ring edge having a guiding surface, and during the pushing of the clamping ring over the lid the guiding surface or guiding surfaces guide the pushing of the clamping ring over the lid, and temporarily widening of the clamping ring.

15. Pail, according to claim 2, wherein the clamping ring comprises a ring edge having a guiding surface for cooperation with the pail end.

16. Pail, according to claim 15, wherein the ring edge comprises an inwardly extending projection which snaps behind the pail end.

17. Pail, according to claim 8, wherein the pail end comprises an outwardly extending guiding surface for the clamping ring.

18. Pail, according to claim 3, wherein the clamping ring comprises a ring edge having a guiding surface for cooperation with the pail end.

19. Pail, according to claim 3, wherein the ring edge comprises an inwardly extending projection which snaps behind the pail end.

20. Pail, according to claim 8, wherein the spring means comprises a compression spring and/or a pull spring.

* * * * *